United States Patent [19]

Petrillo

[11] Patent Number: 4,643,070

[45] Date of Patent: Feb. 17, 1987

[54] TREMOLO DEVICE FOR STRINGED INSTRUMENTS

[76] Inventor: Barry Petrillo, P.O. Box 292, Walden, N.Y. 12586

[21] Appl. No.: 781,517

[22] Filed: Sep. 30, 1985

[51] Int. Cl.[4] ..... G10D 3/12

[52] U.S. Cl. ..... 84/313

[58] Field of Search ..... 84/297 R, 298, 299, 84/313, 312 R

[56] References Cited

U.S. PATENT DOCUMENTS 3,248,991 5/1966 Cole ..... 84/313

4,383,466 5/1983 Shibuya ..... 84/313

*Primary Examiner*—Benjamin R. Fuller

*Attorney, Agent, or Firm*—Jack D. Slobod

[57] ABSTRACT

A tremolo device or tone changer for a stringed instrument includes a generally planar pivottable member on the face of the body of the instrument on which are mounted the bridge and tailpiece. The axis about which the member pivots is directed along and just below the bridge. An arm directed from the member enables manual movement of the member and consequent simultaneous tone changing of all strings. A detent mechanism locks the member in its normal position and a gas spring, located in a cavity in the body below the member, is coupled pivottally to the member for providing smooth resistance to the movement of the member.

6 Claims, 4 Drawing Figures

TREMOLO DEVICE FOR STRINGED INSTRUMENTS

FIELD OF THE INVENTION

The present invention relates generally to tremolo devices or tone changers for stringed instruments and in particular, to the provision of a bridge and tailpiece on a member which pivots upon a transverse axis directly below the bridge.

BACKGROUND OF THE INVENTION

Tremolo devices have heretofore been known for simultaneously adjusting the tension and/or effective lengths of the strings of a stringed instrument to vary the tone of the strings in response to the movement of a manual actuator such as a lever. Illustrative of the state of the art with respect to tremolos for a stringed instrument are U.S. Pat. No. 2,741,146 to Fender, U.S. Pat. No. 4,100,832 to Peterson, and U.S. Pat. No. 4,354,417 to Glaser. While such prior art tremolo devices have taken a variety of forms, I have found that there is a need to produce a tremolo device which is more precise and smooth acting than heretofore possible. A further need to be filled is to provide a tone changing device in which longitudinal movement of the strings over the bridge, or "sawing", is vastly minimized to reduce abrasion of the strings. Furthermore, prior art tremolo devices, have not provided a sufficiently precise means for maintaining the moving parts of the tremolo in its normal position where a tone changing effect is not desired.

OBJECTS OF THE INVENTION

It is an object of the present invention to provide a tremolo device for stringed instruments, particularly of the guitar type, in which the tremolo device has a smooth predictable response to manual actuation thereof.

It is a further object of the present invention to provide a tremolo device for a stringed instrument in which sawing of the strings over the bridge of the instrument in response to actuation of the tremolo is vastly minimized.

It is yet another object of the present invention to provide positive locking means for maintaining the moving parts of the tremolo in their normal position when a tremolo effect is not desired.

SUMMARY OF THE INVENTION

The aforementioned and other objects of the present invention are accomplished by providing in a musical instrument having a plurality of transversely spaced apart longitudinally directed vibratable tension strings carried across the face of an elongated body a tremolo device including a generally planar pivotable member carried on the face of the body proximate an end thereof. On the face of the generally planar member are mounted in longitudinally spaced apart relationship, a bridge and tailpiece. The axis about which the generally planar member pivots is established as longitudinally directed and lying immediately below the bridge in order to minimize the sawing movement of the strings over the bridge as the member is pivotted. An arm, coupled at one end to the generally planar member, and terminating in a handle, is provided to enable manual movement of the generally planar member in response to manual pressure upon the handle. The arm is located so that as the arm is pushed towards the face of the body of the stringed instrument, the tailpiece carries the ends of the strings upward, reducing the tension in the strings and thereby simultaneously lowering the tone of each string.

Smooth proportional resistance characteristics in response to the movement of the arm are provided by a gas spring located in a cavity in the body of the instrument below the generally planar member. The gas spring is coupled at one end pivotally to the generally planar member and at its other end is coupled pivotally to the body of the instrument. The precise and repeatable nature of the spring characteristics of the gas spring provide a smooth and repeatable tone variation in response to movement of the arm.

In order to positively and precisely maintain the pivottable member in its normal position, wherein a tremolo is not desired to be produced, a detent mechanism is provided including a portion thereof carried by the generally planar member.

Other objects, features and advantages of the present invention will become apparent upon perusal of the following detailed description of the preferred embodiment thereof, when taken in conjunction with the appended drawing.

DETAILED DESCRIPTION OF THE PREFERRED EMBODIMENT

Figure 1:
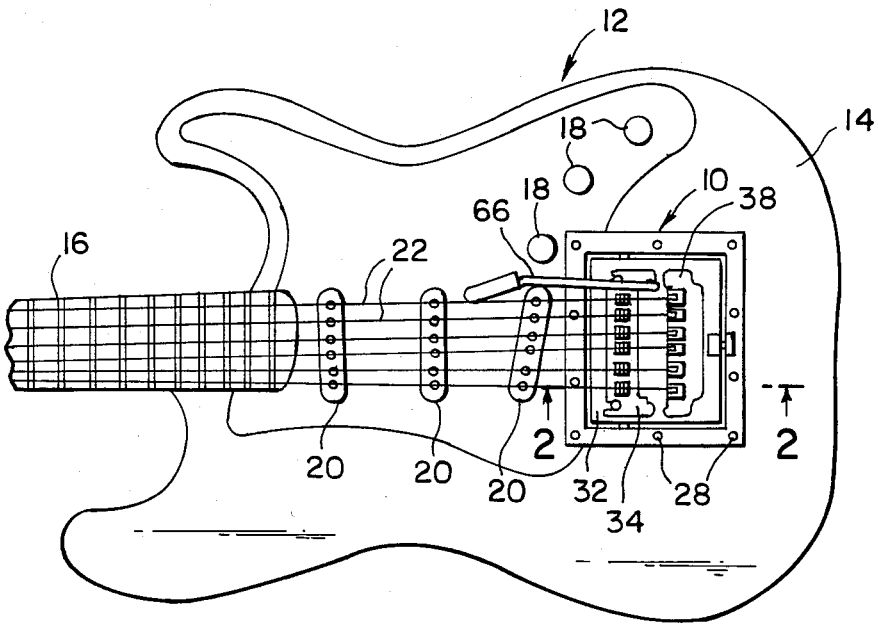
FIG. 1 is a front or top view of the body and portion of the neck of an electric guitar incorporating the tremolo device of the present invention.
Figure 4:
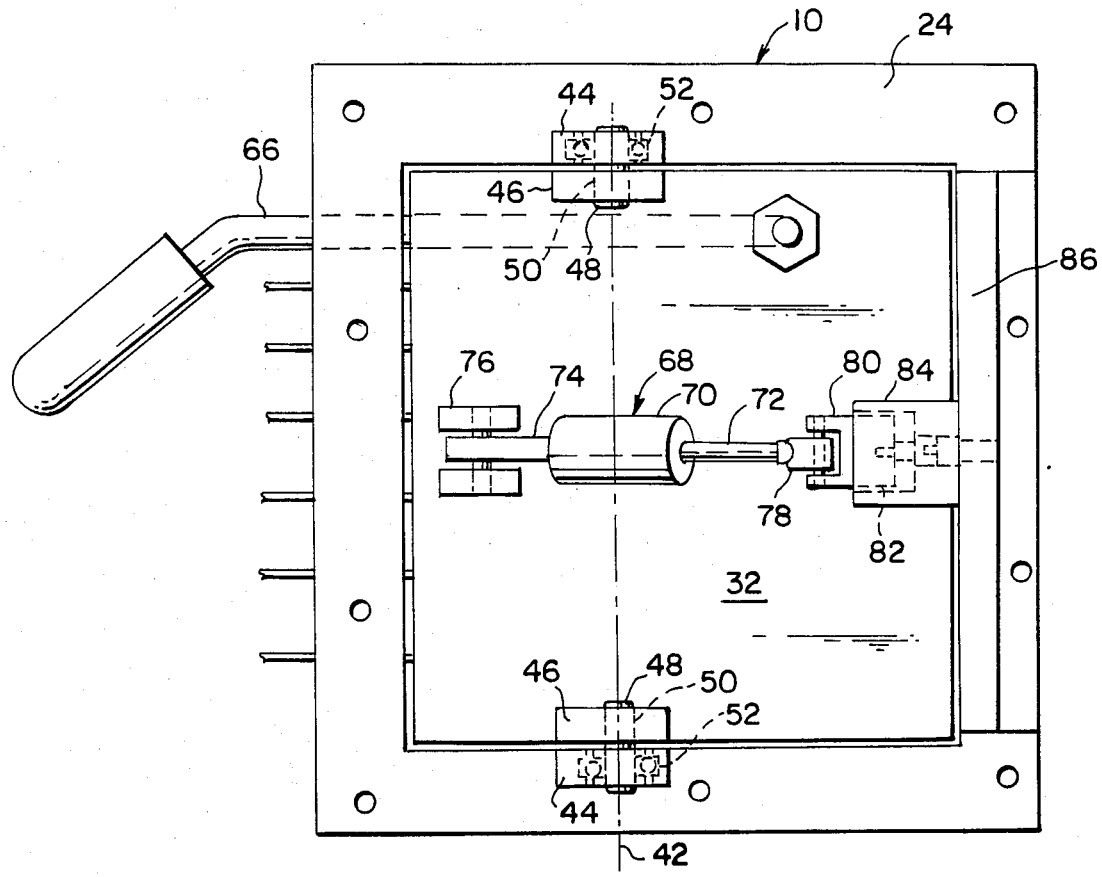
Figure 2:
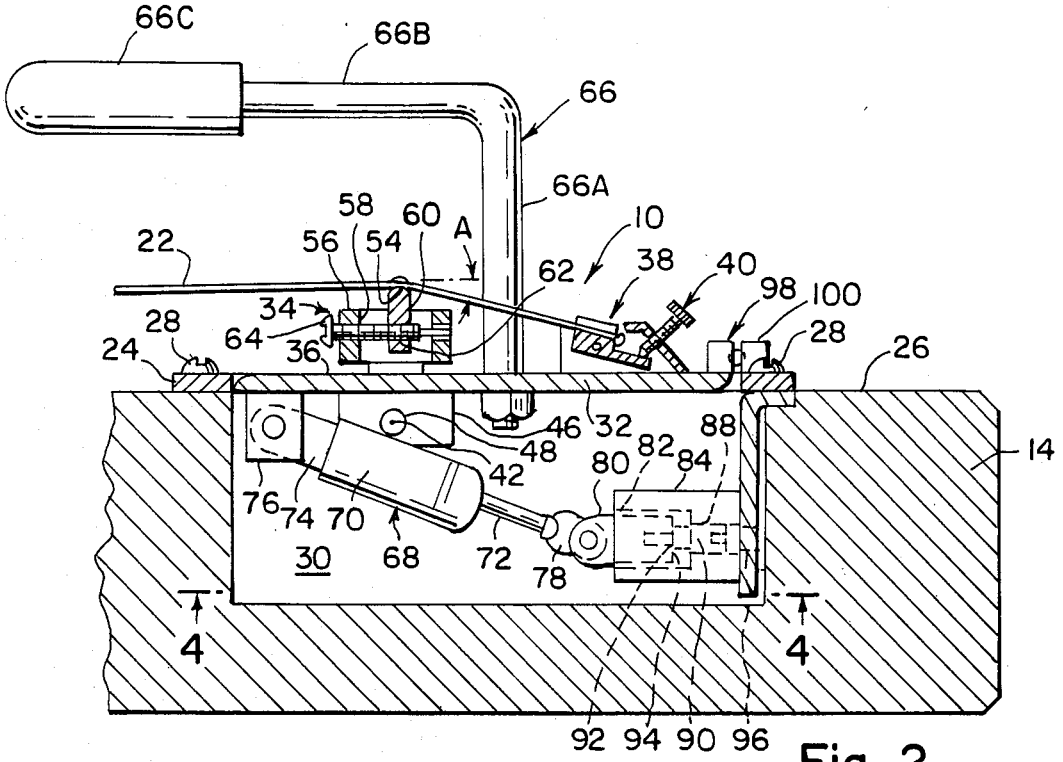
FIG. 2 is a cross sectional, enlarged side view of the tremolo device portion of FIG. 1, taken through the lines 2—2 therein and showing the moving parts of the tremolo device in their normal position when a tremolo effect is not produced.
Figure 3:
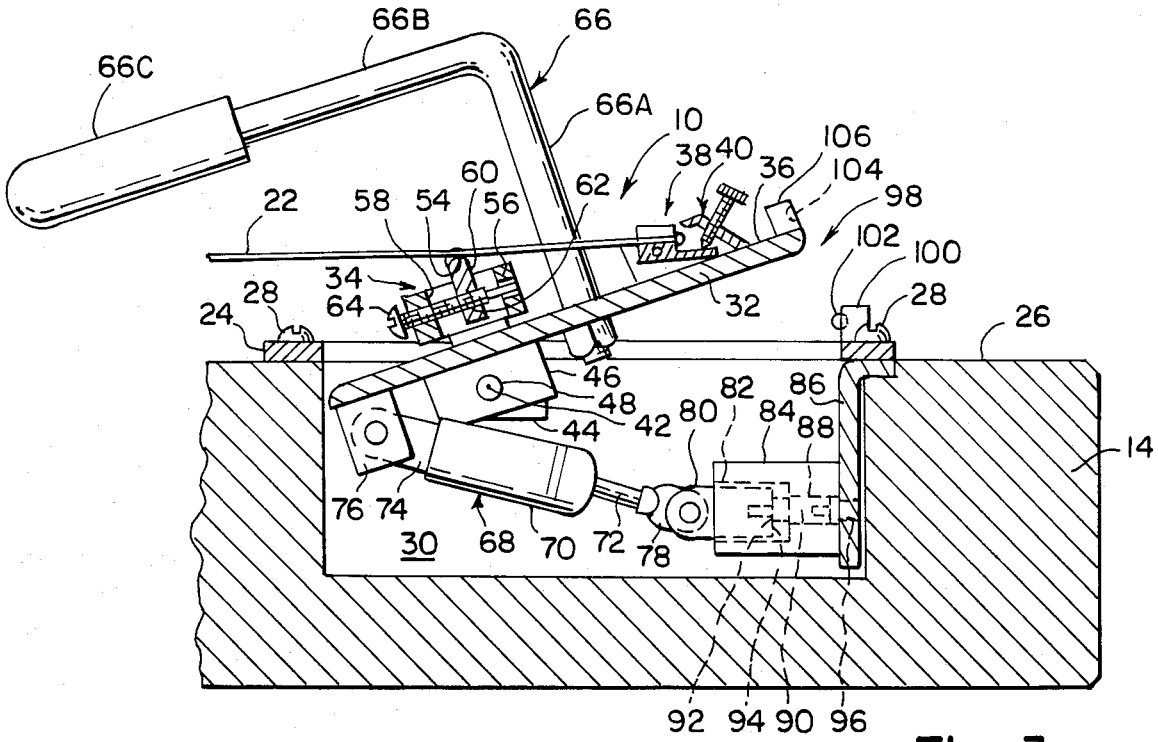
FIG. 3 is a cross sectional side view of the tremolo device, similar to FIG. 2, but with the parts of the tremolo device positioned for maximum tremolo, or tone reduction effect; and, FIG. 4 is a bottom view of the tremolo device of the present invention, taken through the lines 4—4 in FIG. 2.

Referring now to the Drawings in which like reference characters designate like or corresponding parts throughout the several views, there is illustrated in FIG. 1 the tremolo device 10 of the present invention in conjunction with an electrical guitar 12 including a body portion 14 and a neck portion 16. Guitar body 14 includes the usual control knobs 18 and one or more groups of conventional electrical pickups 20 cooperating with the plurality of a vibratable tension and strings 22. With reference also to FIGS. 2 through 4 of the Drawing, tremolo device 10 will become apparent in more detail.

Tremolo device 10 comprises generally a rectangular frame-shaped generally planar metal member 24 secured to the face 26 of the generally solid guitar body 14 by means of screws 28. Frame shaped member 24 is referred to as a "border-plate" because the same surrounds the top of a rectangular cavity or well 30 formed in instrument body 14. Within border plate 24, there is mounted for pivotal movement, rectangular metal plate 32.

As illustrated in FIG. 2, metal plate 32 is normally positioned parallel to and along face 26 of instrument body 14. A bridge 34 is mounted on the top or front face 36 of plate 32 and is directed transversely of the longitudinally directed parallel strings 22. Mounted also to the front or face 36 of plate 32 in longitudinally spaced relationship from bridge 34, is a tailpiece 38 which receives the ends of strings 22 in transversely spaced apart relationship by individual screw actuated locking means 40. As is apparent from the drawings, bridge 34 is mounted closer to neck 16 than is tailpiece 38.

A transversely directed axis about which plate 32 pivots, is established by means of integral ears 44 depending into cavity 30 from opposite transverse margins of border plate 24, which cooperate with ears 46, which downwardly depend into cavity 30 from the transverse margins of plate 32. Co-linear axles 48 which are fixedly mounted in transverse bores 50 in ears 46 are received in bearings 52 and ears 44. The center of the co-linear axles 48 comprise axis 42. The pairs of registered ears 44, 46 and the co-linear axles 48 are positioned so that axis 42 is transversely directed and located immediately below the longitudinal center of bridge 34. This location of axis 42, along with other features which will be mentioned hereafter, vastly reduce longitudinal movement of strings 22 with respect to the operative grooved tips 54 of bridge 34 in response to pivotal movement of plate 32. This serves to minimize abrasion of strings 22 caused by sawing of the strings in grooves 54.

Strings 22 run generally parallel to face 26 of instrument body 14 from the neck 16 until strings 22 are received in bridge grooves 54. As shown in FIG. 2, in the normal position wherein plate 32 remains along instrument body face 26 and a termolo effect is not desired, the strings 22 are bent slightly over grooves 54 and downward towards face 26 through a small acute angle A, on the order of 20 degrees or less to the tailpiece 38. This minimal bending along the top of grooves 54 provides a minimum range of longitudinal contact with grooves 54 to reduce friction and abrasion due to sawing. The bridge 34 is preferably formed by a metal honeycomb structure 56 defining a series of spaced apart rectangular openings 58 in which are mounted for individual longitudinal adjustment, a separate bridge segment 60 for each string 22. Each bridge segment 60 is in the form of an upstanding transversely directed generally planar member having the longitudinally directed string groove 54 at its top. Each bridge segment 60 has a longitudinally directed threaded bore 62 which cooperates with an adjustment screw 64 threaded longitudinally through an upstanding vertical wall of honeycomb shaped member 58. As should be apparent, rotation of screw 64 associated with a particular bridge segment 60 will cause longitudinal movement of said bridge segment.

To enable actuation manually of tremolo device 10, there is provided an arm 66 including segment 66A projecting fixedly and perpendicularly from plate 32 at a location longitudinally intermediate bridge 34 and tailpiece 38. Arm 66 is bent from portion 66A into a segment 66B which is directed parallel to face 26 and toward neck 16. Arm segment 66B terminates in a handle 66C to be gripped by the performer utilizing instrument 12 when it is desired to introduce a tremolo effect in the sound of the instrument. In operation, in order to relax the tension in strings 22 and produce a reduced tone, the handle 66C is pushed toward the face 26 of body 14 resulting in pivotting of plate 32 in a manner to cause the tailpiece to rise above face 26 and reduce angle A. It should be apparent from FIG. 3 of the drawings, that the maximum desirable travel of plate 32 is such that angle A is reduced to nearly 0. It should be further apparent from a comparison of FIGS. 2 and 3 of the drawings that the length reduction of strings 22 in response to pivotting of plate 32 is substantially equal to the amount by which the bridge grooves 54 are rotationally urged longitudinally closer to neck 16. Furthermore, the transverse radius of bridge grooves 54, when chosen to be centered around axis 42, allows grooves 54 to roll along strings 22 in response to rotation of plate 32 and eliminate longitundinal sawing of strings 22 in grooves 54.

In order to provide linear resistence characteristics to the rotation or pivotting of plate 32, there is provided a gas spring 68 of the type manufactured by Stabilus of Postfach, West Germany. Gas spring 68 generally consists an elongated cylindrical housing 70 in which there is a cylindrical chamber (not shown) of pressurized gas cooperating with a piston (not shown) terminating in a push rod 72 directed longitudinally above housing 70. As push rod 72 is urged axially into housing 70, it encounters repeatable and linearly increasing resistance force caused by the piston movement increasing the pressure of gas in the chamber. Housing 70 terminates at the end remote from push rod 72 in a transversely apertured flange 74 which is rotatably pinned between the clevis fork 76 which downwardly projects from the bottom of plate 32 proximate the end of plate 32 which faces neck 16. Gas spring 68 is longitudinally and downwardly directed from clevis 76 toward the tail end of body 14 such that the transversely apertured end 78 of pushrod 72 is rotatably pinned between the forks of clevis block 80. Clevis block 80 is mounted for longitudinally slideable adjustment in a longitudinal bore 82 in block 84. Block 84 is fixedly secured to a downwardly depending flange 86 welded to the tailend of borderplate 24. Block 84 has an axial threaded bore 88 in which is located an Allen screw 90 having a shoulder 92 which bears against the back end 94 of clevis block 80. Allen screw 90 is accessed through a bore 96 in flange 86. When the entire tremolo assembly 10 is detached from body 14, by removal of screws 28, an Allen key may be inserted through bore 96 to rotate Allen screw 90 and move the clevis block 80 in a longitudinal direction for biasing gas spring 68 to a desired compression. As should be apparent from a comparison and examination of FIGS. 2 and 3 as handle 66C is urged towards instrument body face 26 gas spring push rod 72 is urged into gas spring housing 70 creating a substantially linearly increasing resistance to continued movement of handle 66C. Gas spring 68 provides a smooth feel to the performer and repeatable spring characteristics.

A positive locking of pivottable plate 32 in the normal position as illustrated in FIG. 2 is provided by the detent mechanism 98 including an upstanding block 100 secured to the center of the tail portion of borderplate 24 and carrying a longitudinally directed spring loaded ball 102 which is received in a substantially hemispherical dimple 104 in an upstanding block 106 secured fixedly to the rear margin of plate 32 in registered relationship with block 100. As should be apparent, detent mechanism 98 provides engagement between plate 32 and borderplate 24 when they are aligned in the same plane as illustrated in FIG. 2 of the Drawings. The engaged detent mechanism 98 requires an initial force to be manually imparted to handle 66C to break plate 32 from engagement with borderplate 24.

It should now be understood that the preferred embodiment of the present invention has been described and illustrated in specific terms and detail. However, it should be understood that numerous additions, modifications or omissions in such details are possible within the intended spirit and scope of the invention.

What is claimed is:

1. In a musical instrument having a plurality of transversely spaced-apart longitudinally directed vibratable tensioned strings carried across the face of an elongated body, the improvement for selectively simultaneously varying the tension of said strings comprising:

a. a generally planar pivottable member carried on and positionable along the face of said body proximate one end of said body;

b. pivot means coupled between said member and said body establishing an axis directed transversely of said strings and generally below said generally planar pivottable member about which said member may be pivoted;

c. a transversely directed bridge means including tips supporting said strings and carried by the face of said member substantially directly above said axis;

d. a transversely directed tailpiece lockably receiving one end of each said string, said tailpiece being carried by the face of said pivottable member in spaced apart relationship from said bridge;

e. arm means coupled to said pivottable member for enabling selective pivoting of said member by a performer; and f. detent means including mutually engageable portions carried by said generally planar pivottable member and said body for maintaining said generally planar member positioned along the face of said body.

2. The improvement of claim 1 wherein there is a cavity formed in said body below said generally planar member and a telescoping gas spring means in said cavity coupled at one end pivottably to said generally planar member and at the other end to said body for providing resistance to pivotting of said member.

3. The improvement of claim 1 wherein said bridge means comprises a separate bridge segment for each string and means for independently adjusting the longitudinal position of each bridge segment.

4. The improvement of claim 2 wherein said bridge means comprises a separate bridge segment for each string and means for independently adjusting the longitudinal position of each bridge segment.

5. In a musical instrument having a plurality of transversely spaced-apart longitudinally directed vibratable tensioned strings carried across the face of an elongated body, the improvement for selectively simultaneously varying the tension of said strings comprising:

a. a generally planar pivottable member carried on and positionable along the face of said body proximate one end of said body;

b. pivot means coupled between said member and said body establishing an axis directed transversely of said strings and below said generally planar pivottable member about which said member may be pivoted;

c. a transversely directed bridge means including tips supporting said strings and carried by the face of said member substantially directly above said axis;

d. a transversely directed tailpiece lockably receiving one end of each said string, said tailpiece being carried by the face of said pivottable member in spaced apart relationship from said bridge;

e. arm means coupled to said pivottable member for enabling selective pivotting of said member by a performer; and f. wherein there is a cavity formed in said body below said generally planar member and telescoping gas spring means in said cavity coupled at one end pivottably to said generally planar member and at the other end to said body for providing resistance to pivoting of said member.

6. The improvement of claim 5 wherein said bridge means comprises a separate bridge segment for each string and means for independently adjusting the longitudinal position of each bridge segment.

* * * * *